US011243011B2

(12) United States Patent
King

(10) Patent No.: US 11,243,011 B2
(45) Date of Patent: Feb. 8, 2022

(54) HEAT EMITTING RADIATOR

(71) Applicant: Ray King, Pickering (CA)

(72) Inventor: Ray King, Pickering (CA)

( * ) Notice: Subject to any disclaimer, the term of this patent is extended or adjusted under 35 U.S.C. 154(b) by 278 days.

(21) Appl. No.: 16/671,248

(22) Filed: Nov. 1, 2019

(65) Prior Publication Data

US 2020/0064022 A1 Feb. 27, 2020

Related U.S. Application Data

(63) Continuation-in-part of application No. 15/867,544, filed on Jan. 10, 2018, now Pat. No. 11,067,295.

(30) Foreign Application Priority Data

Jan. 10, 2017 (CA) ..... CA 2954184

(51) Int. Cl.
*F24H 3/00* (2006.01)

(52) U.S. Cl.
CPC ..... *F24H 3/004* (2013.01)

(58) Field of Classification Search
CPC ..... F24H 3/004
USPC ..... 219/494; 392/496
See application file for complete search history.

(56) References Cited

U.S. PATENT DOCUMENTS

RE19,781 E * 12/1935 Murray ..... F28D 1/0475 165/131
7,054,548 B2 * 5/2006 Inoue ..... F28F 13/10 165/172
2010/0282442 A1 * 11/2010 Sukuvoy ..... B32B 15/06 165/104.19

* cited by examiner

*Primary Examiner* — Lauren A Crane
(74) *Attorney, Agent, or Firm* — Shawn Gordon, Esq.; Dunkiel Saunders Elliott Raubvogel & Hand, PLLC

(57) ABSTRACT

A heat emitting radiator for heating a space is provided that includes a radiator panel with tubing forming a fluid circuit or loop, wherein the loop includes at least one opening for inserting a heating element that can heat a fluid in the fluid circuit. The radiator may also include a heat absorbing material, such as stone, in thermal contact with the radiator panel. The radiator can be selectively de-activated when a certain temperature has been achieved in the space or in the fluid, allowing heat absorbed by a heat absorbing material positioned within the radiator to then be radiated into the space. The radiator can then be re-activated when a selected low temperature has been reached. The heating element may be a DC electrical heating element configured to be connected to an AC power source.

20 Claims, 7 Drawing Sheets

HEAT EMITTING RADIATOR

RELATED APPLICATION DATA

This application is a continuation-in-part of U.S. patent application Ser. No. 15/867,544, filed Jan. 10, 2018 and titled "Heat Emitting Radiator," which claims priority to Canadian Patent Application No. 2,954,184, filed Jan. 10, 2017 and titled "Heat Emitting Radiator," each of which is incorporated herein by reference in its entirety.

FIELD OF THE INVENTION

The present invention generally relates to the field of heating radiators. In particular, the present invention is directed to a Prolonged Heat Emitting Radiator.

BACKGROUND

It is well known that radiators are used to transfer thermal energy from one medium to another for the purpose of cooling and heating. It is also known that radiators are commonly used to heat homes and buildings. In a central heating system using radiators, hot water or steam is generated in a central boiler and circulated by pumps through radiators within the home or building, where this heat is then transferred to the surroundings. FIG. 1 (prior art) provides an example of such a radiator 1, having connections 2 to, for example, gas lines, power, propane, pumps, pressure gauges, flow switches, filters, and tubing throughout the radiator and home.

However, such systems usually continually draw power and energy for their use, especially in winter, and therefore incur higher heating costs. Furthermore, such systems can have relatively large footprints overall, making them cumbersome to use in smaller spaces. Moreover, radiators can produce very high temperatures at local areas of a room, particularly in an area adjacent the radiator, that can lead to unsafe conditions.

SUMMARY OF THE DISCLOSURE

In an embodiment, a heat emitting radiator for heating a space is provided that includes a radiator panel having a front surface, a first side and a second side, the panel including a first tube on the front surface and extending from the first side to the second side, and a second tube on the front surface beneath the first tube and extending from the first side to the second side. The radiator also includes a first piping connecting the first tube and the second tube on the first side and a second piping connecting the first tube and the second tube on the second side, whereby the first tube, the first piping, the second tube and the second piping form a fluid circuit for retaining coolant therein, wherein the fluid circuit includes at least one opening in communication with the fluid circuit. At least one heating element is inserted into the at least one opening and projecting into the fluid circuit, the at least one heating element being removable without disassembly of the fluid circuit, wherein the at least one heating element is in direct contact with the coolant to heat the coolant. A heat absorbing material contained within the radiator and having a top, a bottom, and a back surface, wherein the back surface of the material faces the front surface of the panel, wherein the top of the material faces the first tube, and wherein the bottom of the material faces and is supported, by the second tube.

In an embodiment, a heat emitting radiator for heating a space is provided that includes a radiator panel having a front surface, a tube having a top portion and a bottom portion, the tube being attached to the front surface of the panel and forming a fluid circuit within the radiator for retaining coolant, wherein the fluid circuit includes at least one opening. At least one heating element is inserted into the at least one opening and projecting into the fluid circuit, wherein the at least one heating element is removable without disassembly of the fluid circuit, and wherein the at least one heating element is in direct contact with the coolant to heat the coolant. A heat absorbing material having a top, a bottom, and a back surface, wherein the back surface of the material faces the front surface of the panel, wherein the top of the material faces the top portion of the tube, and wherein the bottom of the material faces and is supported by the bottom portion of the tube.

In an embodiment. a radiator panel for a heat emitting radiator is provided that includes a front surface having an upper portion and a lower portion, a first tube integrated into the panel on the upper portion, wherein a portion of the first tube extends out from the front surface, and a second tube integrated into the panel on the lower portion, wherein a portion of the second tube extends out from the front surface such that the second tube is designed and configured to support a heat absorbing material between the first tube and the second tube when the front surface is in an upright orientation.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DESCRIPTION OF THE DISCLOSURE

A heat emitting radiator is provided that can generate substantial amounts of heat to heat larger spaces, such as may be required in a home or business, while requiring less power to run than many conventional heating systems incorporating radiators. The heat emitting radiator can be heated in several ways to utilize, and thus avoid extensive restructuring of, existing plumbing and/or electrical lines in a building. In this way, the heat emitting radiator for heating a space may be installed easily. In addition, the heat emitting radiator includes a fluid circuit or loop with an opening for a heating element, which can be selectively activated or de-activated by, for example, a cell phone or the like so that the circuit can be monitored for parameters such as time of use, temperature, and cost of use. The heating element may be removable or replaceable within the radiator. The heat emitting radiator can be a standalone radiator, or can be connected to existing power, plumbing and electrical lines.

In addition or in the alternative, a prolonged heat emitting radiator is a heat emitting radiator as described above that further includes a heat absorbing and radiating substance inserted and secured within the radiator. The heat absorbing and radiating substance absorbs heat from the radiator while it is on and then radiates that heat to the space to be heated for a selected period of time or until a selected temperature is reached in the space or by the fluid in the closed loop fluid flow circuit in the radiator, at which point the radiator is switched back to an active position.

Figure 2:
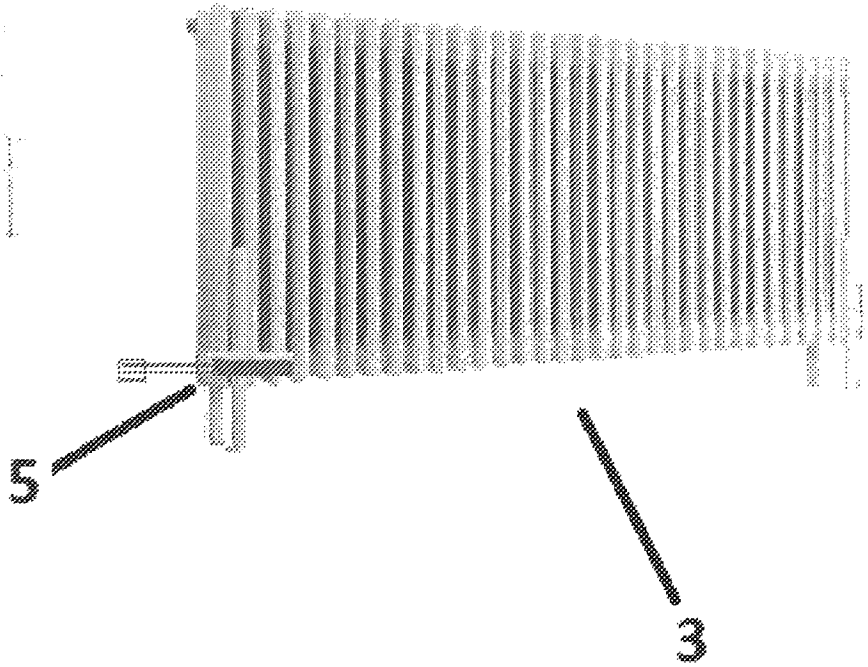
FIG. 2 is a front perspective view of a heat emitting radiator of in accordance with an embodiment of the present invention.
Figure 1:
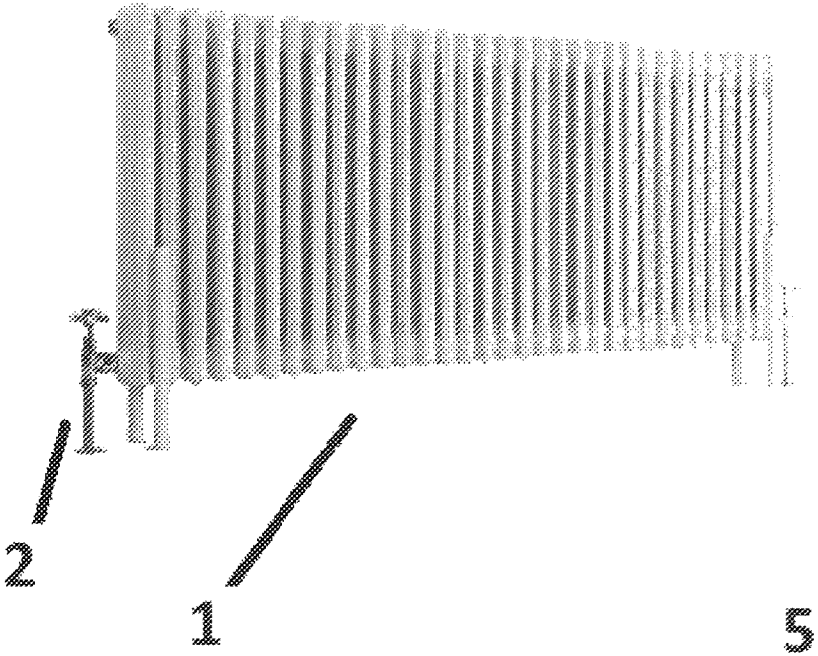
FIGURE 1 (Prior Art)
FIG. 1 is a front perspective view of a prior art radiator.

In a preferred embodiment, and with reference to FIG. 2, a heat emitting radiator of the present invention, such as heat emitting radiator 3, includes a heating element 5. Preferably, heating element 5 is a DC electrical heating element that is connected to and powered by an AC power source, such as through a standard electrical outlet (receptacle). Heating element 5 is easily removable and replaceable if required without disassembly of any other components of radiator 5. In an exemplary embodiment, heating element 5 is made of stainless steel-316 and nickel.

Heating element 5 is supplied with power from a power source (not shown) for enabling heating element 5 to heat the coolant within the fluid circuit contained in radiator 3. In one embodiment, the power source is an electrical type power source, or a power pack, although other types of power sources could be utilized, such as solar power cells, turbine power, AC power, DC power, battery power, wind generated power or the like. A power cell could also be re-energized or re-charged. Heating element 5 may be run on any suitable level of power depending on the use. For many spaces in houses and buildings, heating element 5 may be operated using from between 50 to 300 watts of power. For many applications, heating element may be run on no more than 100 watts of power.

In addition, radiator 3 may include monitoring components for selectively activating or de-activating the radiator through a remote device, and monitoring parameters of the radiator. In an exemplary embodiment, radiator 5 includes a closed loop fluid flow circuit.

Figure 3:
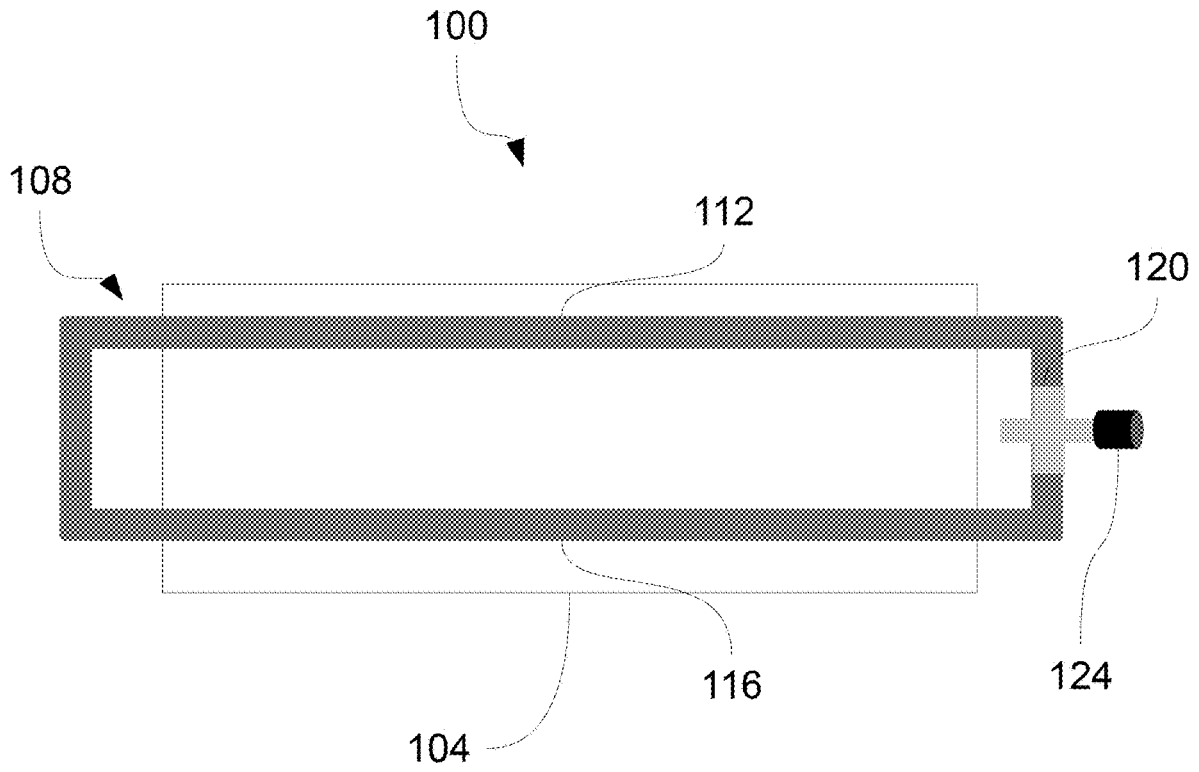
FIG. 3 is a schematic illustration depicting a heat emitting radiator in accordance with another embodiment of the present invention.
Figure 4:
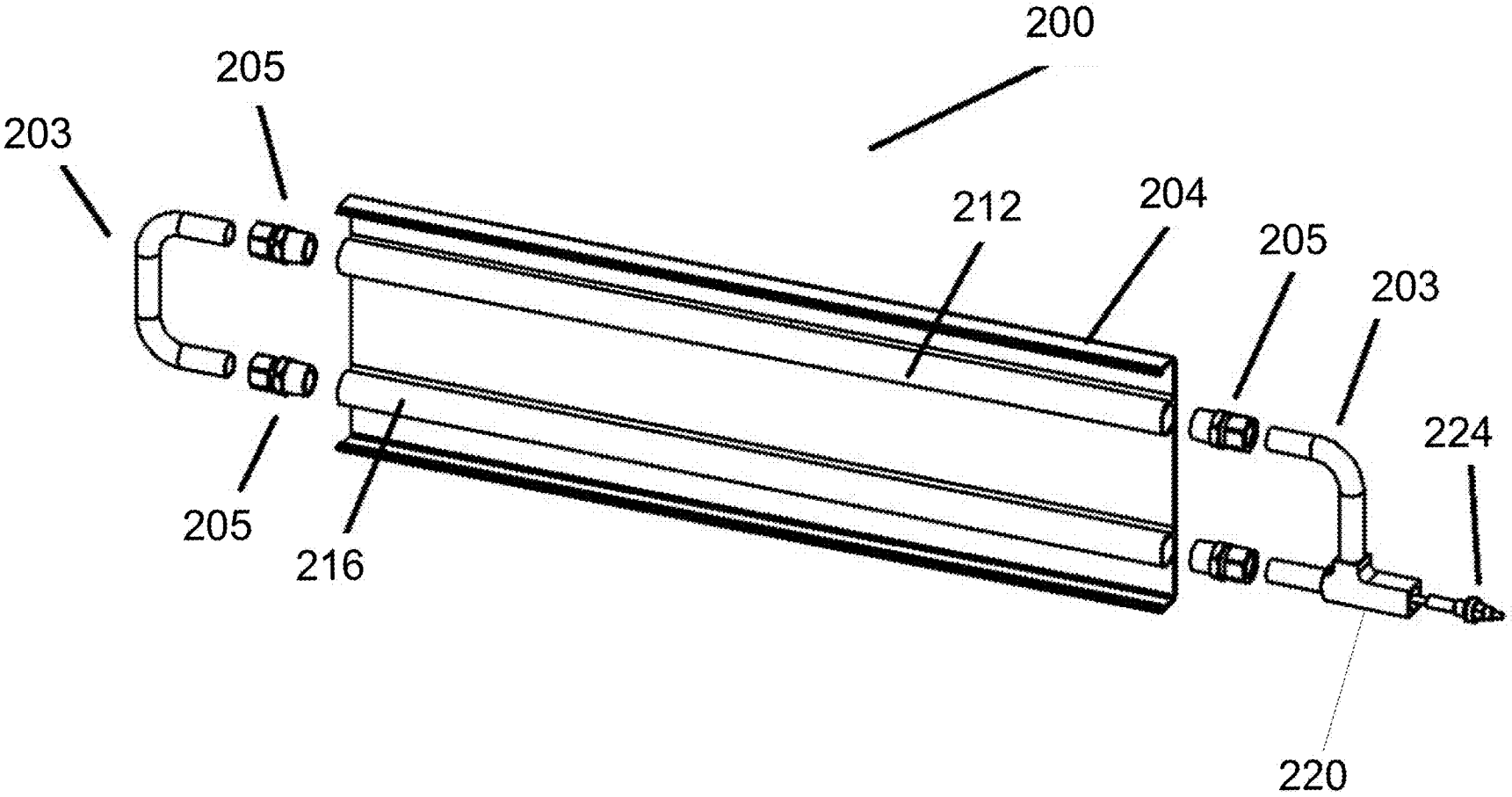
FIG. 4 is a perspective, partially exploded view of a heat emitting radiator in accordance with another embodiment of the present invention.

Turning to FIG. 3, another heat emitting radiator, such as heat emitting radiator 100, includes a radiator panel 104 and a fluid circuit 108. Fluid circuit 108 may be formed from hollow tubes integrated with panel 104 along substantial portions and including an upper portion 112 and a lower portion 116. Fluid circuit 108 will contain coolant which, in an exemplary embodiment, is water.

Fluid circuit 108 also includes at least one opening 120 into which a heating element 124 is inserted to project into fluid circuit 108 to allow heating element 124 to be in communication with the fluid contained in fluid circuit 108. A plurality of such heating elements could also be used. In this manner, radiator 100 can be heated in a variety of ways to avoid restructuring of existing plumbing and electrical lines in a building, as the radiator can be a standalone radiator in which heating element 124 is powered through a standard electrical outlet.

As heating element 124 heats the fluid (coolant) within fluid circuit 108, upper portion 112 of the circuit will heat up more initially while coolant in lower portion 116 of the circuit remains relatively cooler. As heating element 124 continues to heat the circuit, fluid in lower portion 116 will get hotter both from heating element 124 and due to intermixing and flow of the fluid in fluid circuit 108 until the entire circuit is substantially evenly heated. In addition or in the alternative, a pump (not shown) may be included to circulate the fluid within fluid circuit 108 to facilitate uniform heat distribution in fluid circuit 108.

A radiator/covering panel (not shown) can also have visible displays of information that would typically be forwarded to a remote device, such as information concerning thermostatic control and the parameters from one or more sensors.

In an exemplary embodiment, the fluid in fluid circuit 108 is heated by heating element 124 to an appropriate temperature for transferring adequate heat to the space, such as 180 degrees Fahrenheit, at which point heating element 124 is deactivated for a period of time, and no power is supplied to radiator 100 or heating element 124. As heat is transferred from the fluid to the space, the temperature of the fluid will drop until reaching a selected temperature, such as 80-90 degrees Fahrenheit, at which point power is supplied to heating element 124 again provided a thermostat for the space is calling for heat.

In this manner, by virtue of the self-contained nature of radiator 100, the cost of heating a home or space with radiator 100 can be reduced, substantially in some cases.

In another exemplary embodiment, and with reference to FIGS. 4-8, a prolonged heat emitting radiator of the present invention, such as prolonged heat emitting radiator 200, includes a heating absorbing substance, such as a stone slab, positioned in radiator 200, which can be selectively de-activated, allowing heat absorbed by the substance to be radiated to heat a space without utilizing any additional power during that time period, and re-activating radiator 200 when the substance has cooled to a certain degree and a thermostat in the space to be heated calls for heat.

Figure 8:
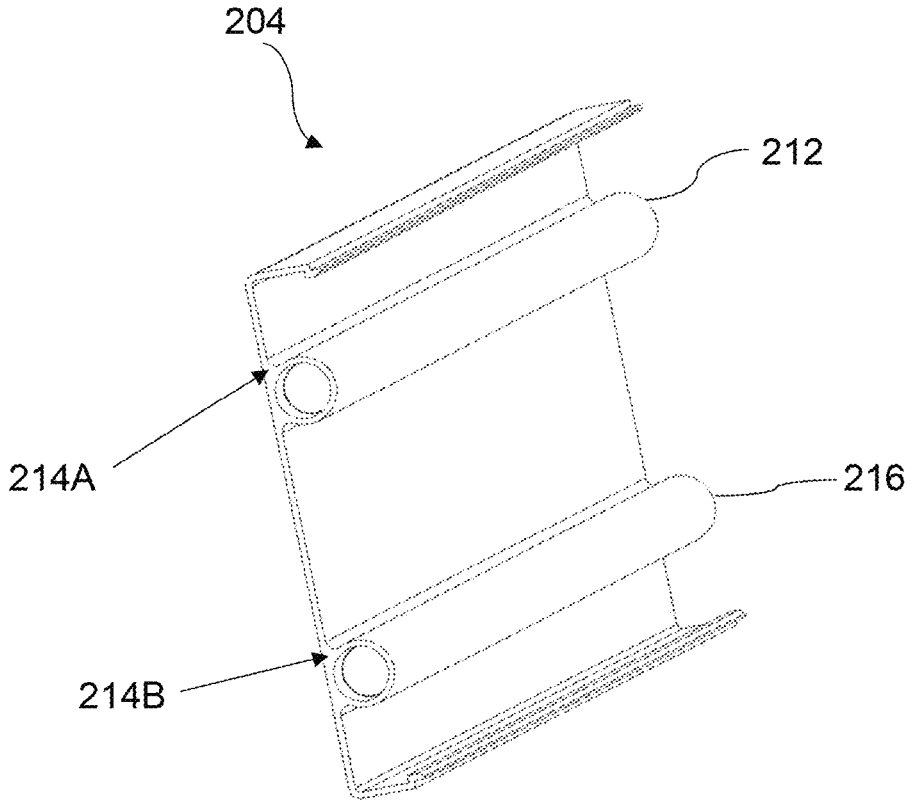
FIG. 8 is a perspective view of a radiator panel in accordance with an embodiment of the present invention.

Prolonged heat emitting radiator 200 includes a radiator panel 204 with a first flow tube 212 and a second flow tube 216, which are preferably integrated into panel 204, as can best be seen in FIG. 8. In a preferred embodiment, tube 212 and tube 216 are formed into the structure of panel 204 by junctions 214 (e.g., 214A, 214B best seen in FIG. 8). First flow tube 212 and second flow tube 216 are interconnected via, for example, piping 203 and, preferably, compression fittings 205 on both ends to form a fluid circuit. (Alternatively, the radiator can use a closed loop fluid flow circuit for permitting a flow of the coolant therethrough, wherein a pump could circulate the coolant throughout the closed loop fluid flow circuit as it is heated by heating elements. In an exemplary embodiment, the closed loop fluid flow circuit will preferably be in a vacuum environment.)

A heating element 224 is inserted into an opening 220 in the fluid circuit such that a portion of heating element 224 projects into the fluid circuit in order to heat the fluid in the fluid circuit. Preferably, heating element 224 is a DC electrical heating element, however other types of heating elements may be used. These can be easily removable and replaceable if required, without disassembly of any other components of the fluid circuit or the closed loop fluid flow circuit. In an exemplary embodiment, the heating elements are made of stainless steel-316 and nickel.

Heating element 224 is supplied with power from a power source (not shown) for enabling heating element 224 to heat the fluid within the fluid circuit. Power wiring connections to heating element 224 operably connect heating element 224 to a power source, which can be a power pack, solar power cells, turbine power, wind generated power, a battery, or the like, and can be either AC or DC power.

Figure 5:
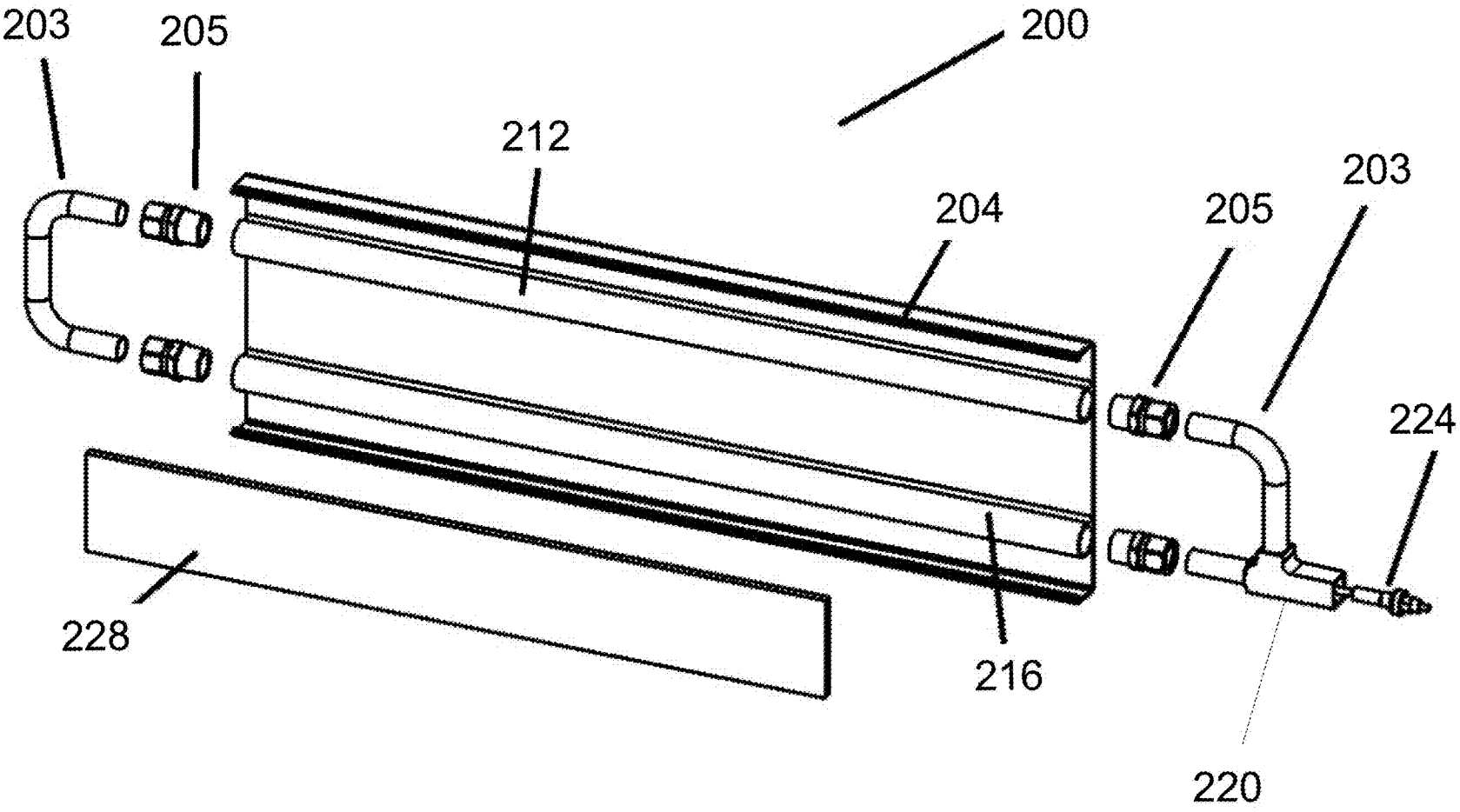
FIG. 5 is a perspective, partially exploded view of the heat emitting radiator of FIG. 4 with a heat absorbing slab.
Figure 6:
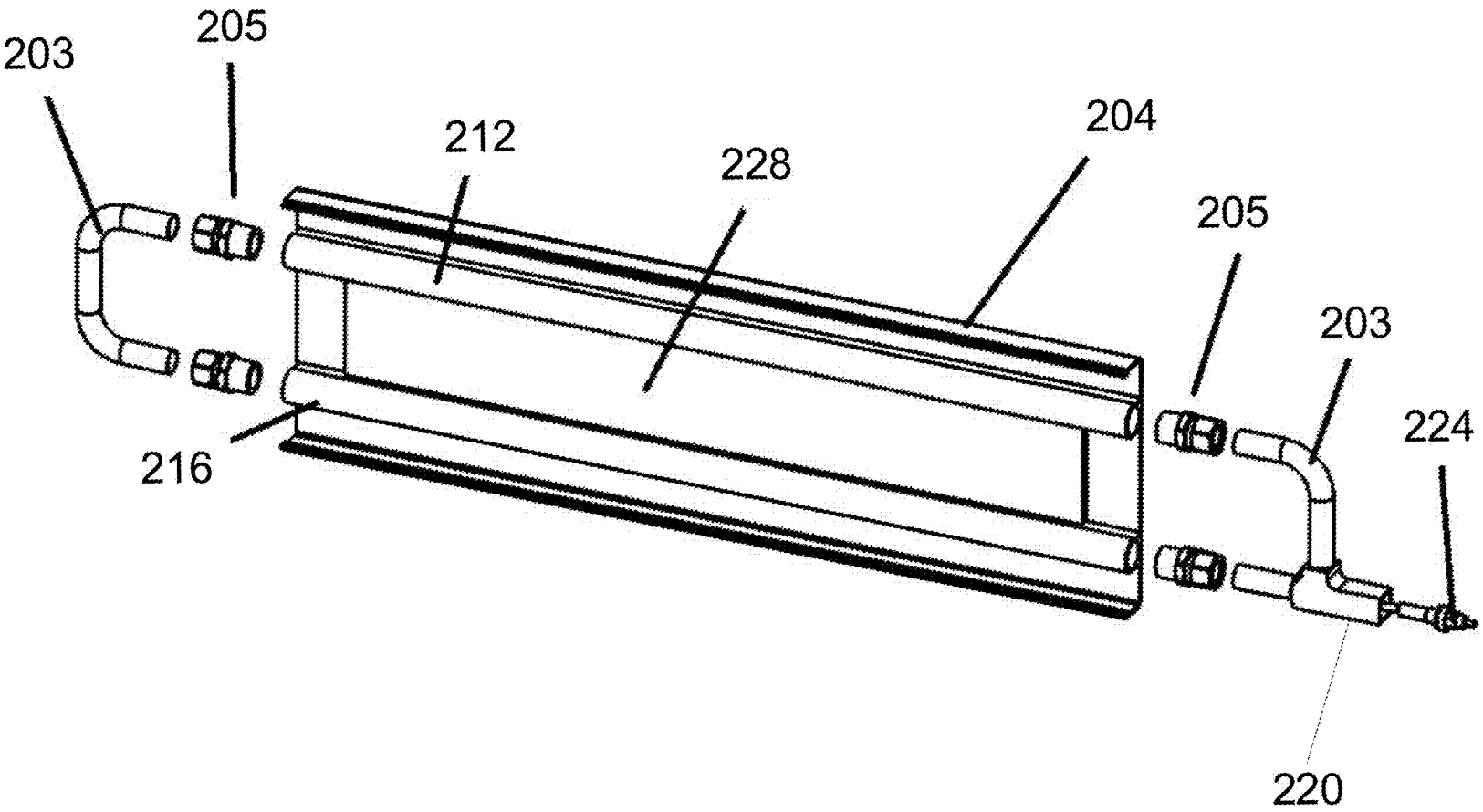
FIG. 6 is a perspective, partially exploded view of the heat emitting radiator of FIG. 4 with the heat absorbing slab inserted in the radiator.

Radiator 200 also includes a heat absorbing and radiating substance, such as a stone slab or similar. In a preferred embodiment, this substance is soapstone. A heat absorbing slab 228 is shown in FIG. 5 as part of an exploded view of radiator 200, while in FIG. 6 slab 228 is shown in position within radiator 200. As can be seen, slab 228 is preferably sized and shaped such that slab 228 fits between flow tube 212 and flow tube 216, and has a depth that is similar to or less than the amount that the tubes protrude from a surface of panel 204. Using the preferred structural integration of flow tube 212 and flow tube 216 into panel 204 and by fitting slab 228 between them, panel 204 is able to support the weight of slab 228 without compromising the fluid circuit. By supporting the weight of slab 228 through panel 204, the weight of slab 204 can be supported by a wall if radiator 200 is attached to a wall or bottom supports (not shown) if radiator 200 is freestanding.

Figure 7:
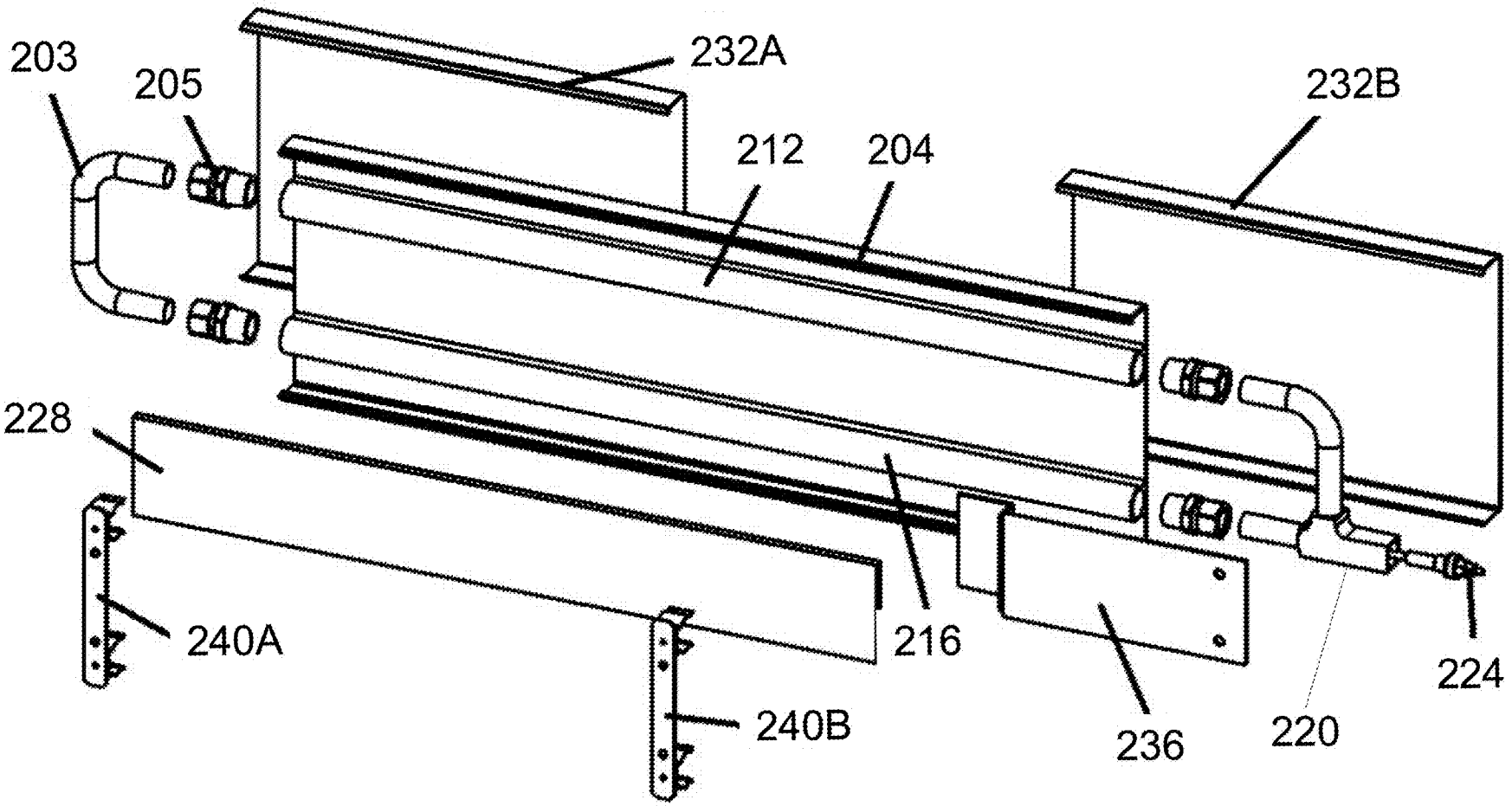
FIG. 7 is a perspective, partially exploded view of the heat emitting radiator of FIG. 4 showing front and rear covers as well as clamps.

In addition, prolonged heat emitting radiator 200 may include C-clamps 240 (e.g., 240A, 240B in FIG. 7) or similar attachment mechanisms to further secure slab 228 within radiator 200. C-clamps 240 may be secured through a front cover panel 236, which also serve to cover piping 203, compression fittings 205, and heating element 224. Also shown in FIG. 7 are rear cover panels 232 (e.g., 232A, 232B), which may be included to cover components such as the wiring connections and the rear of piping 203 and heating element 224, as well as the rear of panel 204. C-clamps 240 may operate by securing front cover panel 236 and rear cover panels 232 to one another by any suitable mechanism such as screws or the like, and thereby also securely holding slab 228 in immediate adjacent contact with radiator panel 204 and front cover 236, along with flow tube 212 and flow tube 216. In an alternative embodiment, an air gap is provided between the front cover panel 236 and slab 228.

In an exemplary embodiment, the fluid circuit or closed loop fluid flow circuit in radiator 200 is heated by heating element 224, for example to about 180 degrees Fahrenheit, at which heating element 224 may be deactivated for a period of time, and no power need be supplied to radiator 200 or heating element 224 for heating purposes. Once this occurs, heat from slab 228 that has been absorbed from communication or adjacent contact with the fluid circuit or closed loop fluid flow circuit in radiator 200 is radiated out into the space to be heated. Slab 228 will radiate this heat out for a period of time, which can usually be effective for many heating purposes for 1 hour to 2 hours. Radiator 200 is again activated to an active position when a selected temperature within the fluid circuit or closed loop fluid flow circuit or in a thermostat for the space being heated has been reached. In an exemplary embodiment, this temperature is 80-90 degrees Fahrenheit for the coolant (assuming the thermostat is calling for heat) and 70 degrees Fahrenheit for the thermostat.

In this manner, the cost of heating a home utilizing prolonged heat emitting radiator 200 can be reduced and a more comfortable heated space provided due to the steadier heating and cooling of a room.

Optionally, the radiator may have a thermostatic control in association with the heating element and the other components therein, in a conventional known manner, and which would be adapted to turn the heating element off when a temperature of the coolant within the fluid circuit or closed loop fluid flow circuit meets a pre-determined level, or when it is detected that a component has failed.

For example, if the pump malfunctions and is no longer circulating the coolant, or if there is insufficient coolant in the system, the thermostatic safety controls effects the shutdown of the heating element. Additionally, the thermostatic control can be adapted to turn heating elements on when a temperature of the coolant within the radiator falls below a pre-determined level. In an alternative embodiment, a timer can also be utilized to selectively pre-set a temperature at which to activate and/or de-activate the heating elements.

In a further exemplary embodiment, the radiator could also be selectively activated (or deactivated) by a remote device by a user.

Exemplary embodiments have been disclosed above and illustrated in the accompanying drawings. It will be understood by those skilled in the art that various changes, omissions, and additions may be made to that which is specifically disclosed herein without departing from the spirit and scope of the present invention.

What is claimed is:

1. A heat emitting radiator for heating a space comprising:

a radiator panel having a front surface, a first side and a second side, the panel including a first tube on the front surface and extending from the first side to the second side, and a second tube on the front surface beneath the first tube and extending from the first side to the second side;

a first piping connecting the first tube and the second tube at the first side and a second piping connecting the first tube and the second tube at the second side, wherein the first tube, the first piping, the second tube, and the second piping form a fluid circuit for retaining coolant therein, and wherein the fluid circuit includes an access aperture;

a heating element inserted into the access aperture and projecting into the fluid circuit, the heating element being removable without disassembly of the fluid circuit, wherein a portion of the heating element is in direct contact with the coolant when inserted into the access aperture; and a heat absorbing material contained within the radiator and having a top, a bottom, and a back surface, wherein the back surface of the material faces the front surface of the panel, wherein the top of the material faces the first tube, and wherein the bottom of the material faces and is at least partially supported by the second tube.

2. The heat emitting radiator of claim 1, wherein the heat absorbing material is a slab.

3. The heat emitting radiator of claim 2, wherein the slab is a stone.

4. The heat emitting radiator of claim 1, wherein the heating element is a DC electrical heating element configured to be connected to and powered by an AC power source.

5. The heat emitting radiator of claim 1, wherein the radiator further comprises a pump for continuously circulating the coolant through the fluid circuit.

6. The heat emitting radiator of claim 1, wherein the first tube includes a top portion and a bottom portion and wherein the top portion is connected to the panel via a first junction that is continuous with the front surface of the panel and the bottom portion is connected to the panel via a second junction that is continuous with the front surface of the panel.

7. The heat emitting radiator of claim 6, wherein the second tube includes a top portion and a bottom portion and wherein the top portion is connected to the panel via a third junction that is continuous with the front surface of the panel and the bottom portion is connected to the panel via a fourth junction that is continuous with the front surface of the panel.

8. The heat emitting radiator of claim 7, further including a front cover and a rear cover.

9. The heat emitting radiator of claim 8, further including a securement mechanism configured to secure the front cover to the panel such that the front cover covers the first tube and the second tube and is positioned to secure the heat absorbing material in place.

10. The heat emitting radiator of claim 9, wherein the securement mechanism is further configured to secure the rear cover.

11. The heat emitting radiator of claim 1, wherein the radiator is freestanding.

12. The heat emitting radiator of claim 11, wherein the radiator is configured to be attached to a wall.

13. A heat emitting radiator for heating a space, comprising:

a radiator panel having a front surface;

a tube having a top portion and a bottom portion, the tube being attached to the front surface of the panel and forming a fluid circuit within the radiator for retaining coolant, wherein the fluid circuit includes at least one opening;

at least one heating element inserted into the at least one opening and projecting into the fluid circuit, wherein the at least one heating element is removable without disassembly of the fluid circuit, and wherein the at least one heating element is in direct contact with the coolant to heat the coolant; and a heat absorbing material having a top, a bottom, and a back surface, wherein the back surface of the material faces the front surface of the panel, wherein the top of the material faces the top portion of the tube, and wherein the bottom of the material faces and is supported by the bottom portion of the tube.

14. The heat emitting radiator of claim 13, further including a pump for continuously circulating the coolant through the fluid circuit.

15. The heat emitting radiator of claim 13, wherein the heat absorbing material is a slab.

16. The heat emitting radiator of claim 15, wherein the slab is soapstone.

17. The heat emitting radiator of claim 13, wherein the heating element is a DC electrical heating element configured to be connected to and powered by an AC power source.

18. The heat emitting radiator of claim 17, wherein the AC power source is an electrical receptacle.

19. A radiator panel for a heat emitting radiator comprising:

a front surface having an upper portion and a lower portion;

a first tube integrated into the panel on the upper portion, wherein a portion of the first tube extends out from the front surface; and a second tube integrated into the panel on the lower portion, wherein a portion of the second tube extends out from the front surface such that the second tube is designed and configured to support a heat absorbing material between the first tube and the second tube when the front surface is in an upright orientation.

20. The radiator panel according to claim 19, wherein the second tube includes a top portion and a bottom portion and wherein the top portion is connected to the panel via a first junction that is continuous with the front surface of the panel and the bottom portion is connected to the panel via a second junction that is continuous with the front surface of the panel.

* * * * *